US010692479B2

(12) United States Patent
Abe et al.

(10) Patent No.: US 10,692,479 B2
(45) Date of Patent: Jun. 23, 2020

(54) MUSICAL INSTRUMENT PICKUP AND MUSICAL INSTRUMENT

(71) Applicant: YAMAHA CORPORATION, Hamamatsu-shi (JP)

(72) Inventors: Banri Abe, Hamamatsu (JP); Tetsuya Yamakoshi, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 16/284,007

(22) Filed: Feb. 25, 2019

(65) Prior Publication Data

US 2019/0287507 A1 Sep. 19, 2019

(30) Foreign Application Priority Data

Mar. 16, 2018 (JP) ..... 2018-049828

(51) Int. Cl.
*G10H 3/14* (2006.01)

(52) U.S. Cl.
CPC ..... *G10H 3/14* (2013.01); *G10H 2220/461* (2013.01)

(58) Field of Classification Search
CPC ..... G10H 3/14; G10H 2220/461
USPC ..... 84/723
See application file for complete search history.

(56) References Cited

U.S. PATENT DOCUMENTS

| | | | | |
|---|---|---|---|---|
| 3,542,936 | A * | 11/1970 | Babicky | G10H 3/20 84/723 |
| 4,310,730 | A * | 1/1982 | Aaroe | H04R 1/46 188/268 |
| 4,495,641 | A * | 1/1985 | Vernino | G10H 3/146 381/162 |
| 4,903,563 | A * | 2/1990 | Mizuguchi | G10H 3/20 84/723 |
| 5,212,336 | A * | 5/1993 | Barcus | G10H 3/146 84/192 |
| 8,609,970 | B2 * | 12/2013 | May | G10D 13/08 84/104 |
| 2010/0037756 | A1 * | 2/2010 | May | G10D 13/08 84/723 |
| 2014/0060291 | A1 * | 3/2014 | Davies | G10D 1/02 84/734 |
| 2017/0206881 | A1 * | 7/2017 | Ekuni | G10H 3/146 |
| 2018/0209838 | A1 * | 7/2018 | Miyata | G10H 3/143 |
| 2018/0211645 | A1 * | 7/2018 | Abe | G10H 3/143 |
| 2019/0096375 | A1 * | 3/2019 | May | G10H 3/143 |

FOREIGN PATENT DOCUMENTS

JP S6340197 A 2/1988

* cited by examiner

*Primary Examiner* — Jeffrey Donels
(74) *Attorney, Agent, or Firm* — Rossi, Kimms & McDowell LLP

(57) ABSTRACT

A musical instrument pickup includes a vibrating body that is disposed facing a plurality of sound sources and excited in response to sounds from the sound sources, and a sensor that detects vibration of the vibrating body.

20 Claims, 3 Drawing Sheets

MUSICAL INSTRUMENT PICKUP AND MUSICAL INSTRUMENT

BACKGROUND OF THE INVENTION

Field of the Invention

The present invention relates to a musical instrument pickup and a musical instrument.

Priority is claimed on Japanese Patent Application No. 2018-49828, filed Mar. 16, 2018, the content of which is incorporated herein by reference.

Description of Related Art

Conventionally, in musical instruments having a plurality of sound sources that generate tones in response to an action by a player, such as keyboard percussion instruments like a xylophone, a glockenspiel, a celesta and the like as well as chimes, various methods have been conceived to pick up those tones.

Japanese Unexamined Patent Application, Publication No. S63-040197 (Patent Document 1) discloses a constitution in which a strike member to which a sensor is attached is arranged between tone bars of a keyboard percussion instrument such as a marimba, a xylophone, a vibraphone. The sensor that is disclosed in Patent Document 1 picks up tones generated in the strike member by detecting vibrations generated by a strike applied to the strike member.

In order to pick up the tones of a musical instrument having a plurality of sound sources such as keyboard percussion instruments, it is conceivable to provide a sensor for each sound source as in the case of Patent Document 1. However, when the sensor is attached directly to a sound source such as a tone bar, the problem arises of acoustic characteristics of the sound source (for example, pitch, attenuation characteristics, tone color, and the like) being altered.

Also, since the number of sensors becomes numerous in musical instruments with a large number of sound sources, such as a keyboard percussion instruments, mounting and maintenance of the sensors on the sound sources becomes troublesome (for example, the wiring arrangement becomes complicated and so understanding where troubles occur can be difficult).

The present invention was achieved in view of the above circumstances and has as its object to provide a musical instrument pickup that can pick up sounds of a musical instrument having a plurality of sound sources without affecting the acoustic characteristics of the sound sources, and that enables installation work and maintenance work to be easily performed, and a musical instrument provided with the musical instrument pickup.

SUMMARY OF THE INVENTION

A musical instrument pickup of the present invention is provided with a vibrating body that is disposed facing a plurality of sound sources and that is excited in response to sounds from the sound sources, and a sensor that detects vibration of the vibrating body.

DETAILED DESCRIPTION OF THE INVENTION

A preferred embodiment of the present invention will be described with reference to FIGS. 1 to 4. In the present embodiment, as a musical instrument according to the present invention, a keyboard percussion instrument 1 such as a marimba, a type of wooden idiophone, or a vibraphone, a type of metal idiophone, is exemplified.

Figure 1:
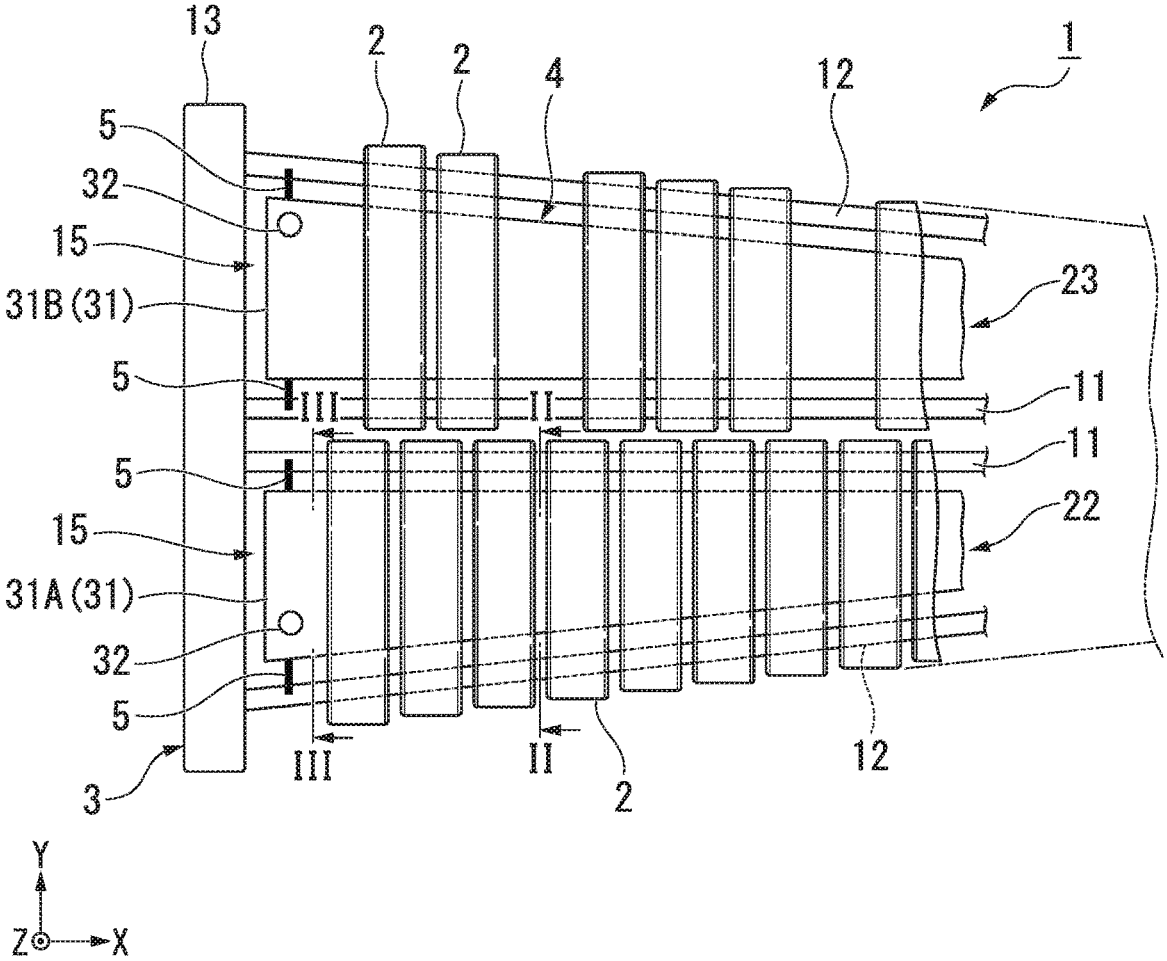
FIG. 1 is a plan view of a musical instrument including a musical instrument pickup according to one embodiment of the present invention.
Figure 2:
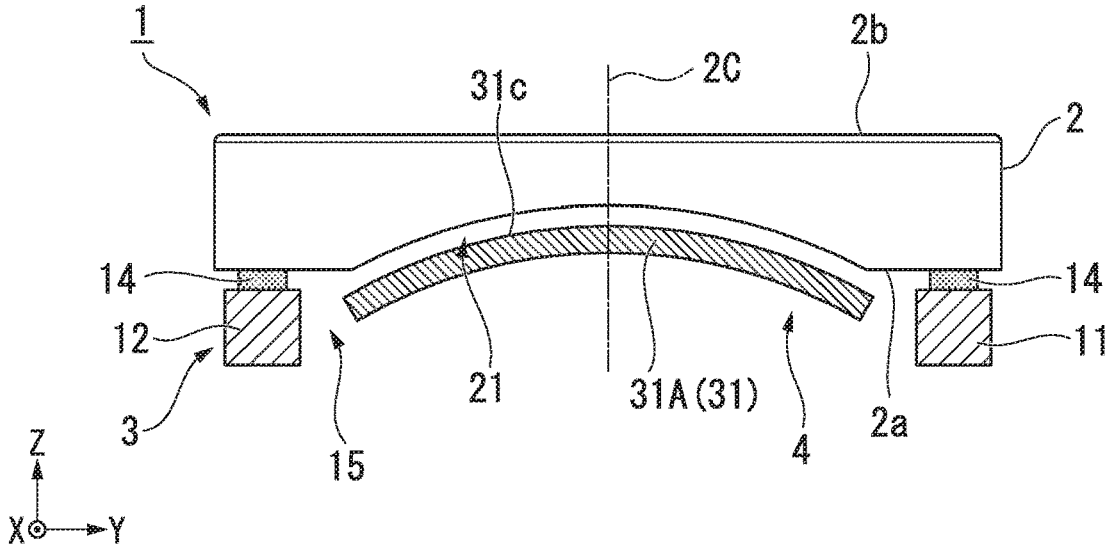
FIG. 2 is a cross-sectional view along arrows II-II in FIG. 1.
Figure 3:
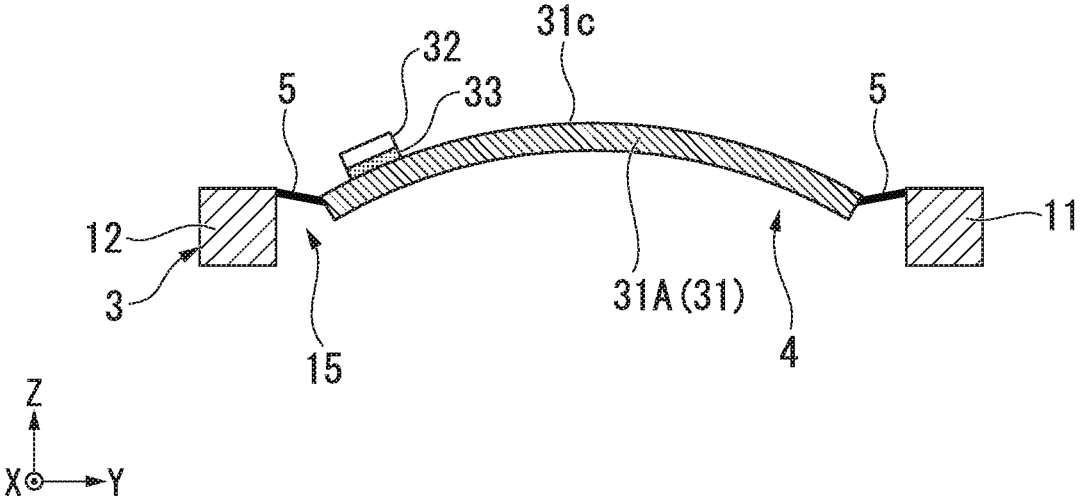
FIG. 3 is a cross-sectional view along arrows III-III in FIG. 1.

In FIGS. 1 to 3, the left-right direction of the keyboard percussion instrument 1 as viewed from the player of the keyboard percussion instrument 1 is defined as an X-axis direction, the front-back direction of the keyboard percussion instrument 1 is taken as a Y-axis direction, and the vertical direction of the keyboard percussion instrument 1 is a Z-axis direction.

As shown in FIGS. 1 and 2, the keyboard percussion instrument 1 includes a plurality of tone bars 2 (sound sources). In addition, the keyboard percussion instrument 1 includes a frame 3 that supports the plurality of tone bars 2.

The specific configuration of the frame 3 may be arbitrarily determined. The frame 3 of the present embodiment is provided with two first beams 11, two second beams 12, and two third beams 13.

The two first beams 11 extend in one direction (X-axis direction) in parallel to each other. The two second beams 12 are arranged on the outside of the two first beams 11 in the arrangement direction of the two first beams 11 (Y-axis direction). Each second beam 12 extends so that a respective gap with the first beam 11 decreases from one side to the other side in the lengthwise direction of the first beam 11 (from the left side to the right side in FIG. 1). The two third beams 13 extend in the arrangement direction of the two first beams 11 and the second beams 12. The two third beams 13 are connected to both ends of the first beams 11 and the second beams 12 in the lengthwise direction thereof. In FIG. 1, only the third beam 13 located on the left side among the two third beams 13 is shown, with the third beam 13 positioned on the right side being omitted.

Each tone bar 2 is formed in a plate shape. Each tone bar 2 is arranged on an upper side of the first beam 11 and the second beam 12 adjacent to each other in the Y-axis direction so that the lengthwise direction thereof is oriented in the Y-axis direction. As a result, both end portions of each tone bar 2 in the lengthwise direction are supported by the first beam 11 and the second beam 12. In FIG. 2, a felt member 14 is provided between the tone bar 2 and the first beam 11 and between the tone bar 2 and the second beam 12.

A concave portion 21 is formed in each tone bar 2. The concave portion 21 is formed so as to be recessed from a surface 2*a* (lower surface 2*a*) facing the frame 3 side (the first beam 11 side, the second beam 12 side) of the tone bar 2. The concave portion 21 is formed in the middle of the tone bar 2 located between the first beam 11 and the second beam 12 in the Y-axis direction.

Each tone bar 2 generates a sound by an upper surface 2*b* thereof being struck with a mallet or the like. More specifically, when the tone bar 2 is struck, the tone bar 2 vibrates, with the sections thereof supported by the frame 3 (that is, the first beam 11 and the second beam 12) serving as nodes. Sound is generated from the tone bar 2 by this vibration. The sound generated in the tone bar 2 includes a fundamental tone and overtones. The fundamental tone is the sound generated when the tone bar 2 vibrates in the primary mode of vibration. Overtones are sounds generated when the tone bar 2 vibrates in a secondary mode, a tertiary mode, and the like. In the vibrations of the primary mode and the tertiary mode, antinodes of the vibrations are located in a middle 2C of the tone bar 2 in the lengthwise direction. In the vibration of the secondary mode, the node of the vibration is positioned in the middle 2C of the tone bar 2.

The plurality of tone bars 2 generate sounds of different notes. The plurality of tone bars 2 are arranged in the X-axis direction. The plurality of tone bars 2 are constituted by a first tone bar group 22 arranged in the X axis direction on the near side (the Y-axis negative direction side) and a second tone bar group 23 arranged in the X-axis direction to the rear (the Y-axis positive direction side) of the first tone bar group 22. The plurality of tone bars 2 constituting the first tone bar group 22 respectively generate natural tones (tones with the note names of C, D, E, F, G, A, B). The plurality of tone bars 2 constituting the second tone bar group 23 respectively generate accidental tones (tones with the note names of C #, D #, F #, G #, and A #).

As shown in FIGS. 1 to 3, the keyboard percussion instrument 1 is provided with a musical instrument pickup 4. The musical instrument pickup 4 is provided with a vibrating body 31 and a sensor 32.

The vibrating body 31 is arranged facing the plurality of tone bars 2. That is, the vibrating body 31 is arranged spaced apart from the plurality of tone bars 2. The interval between the vibrating body 31 and the plurality of tone bars 2 may be arbitrarily determined, but it is more preferably set to be small to an extent that the tone bars 2 do not make contact with the vibrating body 31 even if the tone bars 2 vibrate.

In the present embodiment, the vibrating body 31 is disposed at a lower surface 2*a* side of the plurality of tone bars 2. For example, just one vibrating body 31 may be arranged on the lower surface 2*a* side of all the tone bars 2. The vibrating body 31 of the present embodiment is provided with a first vibrating body 31A disposed on the lower surface 2*a* side of the plurality of tone bars 2 constituting the first tone bar group 22 and a second vibrating body 31B disposed on the lower surface 2*a* side of the plurality of tone bars 2 constituting the second tone bar group 23.

Each vibrating body 31 (31A, 31B) extends in the arrangement direction of the plurality of tone bars 2 in each tone bar group 22 and 23 (that is, the X-axis direction). Each vibrating body 31 should be formed so as to be arranged on the lower surface 2*a* side of at least two tone bars 2 arranged in the X-axis direction. That is, the dimension of the vibrating body 31 in the X-axis direction should be greater than the distance between two tone bars 2 arranged in the X-axis direction. Specifically, the dimension of the vibrating body 31 in the X-axis direction should be equal to or greater than the sum of the dimension of two tone bars 2 in the X-axis direction and the dimension of an interval between the two tone bars 2. Therefore, a plurality of vibrating bodies 31 may be arranged, for example, in the X-axis direction. In this embodiment, the one first vibrating body 31A corresponds to all the tone bars 2 constituting the first tone bar group 22, and the one second vibrating body 31B corresponds to all the tone bars 2 constituting the second tone bar group 23.

The first vibrating body 31A and the second vibrating body 31B are each positioned in a respective region 15 (placement region 15) surrounded by the first beam 11, the second beam 12, and the third beams 13 of the frame 3 in plan view of the keyboard percussion instrument 1 as viewed from the Z-axis direction. That is, the first vibrating body 31A and the second vibrating body 31B are each located inside a portion of the frame 3 forming the placement region 15.

The vibrating body 31 is excited (acoustically excited) in response to sound from the tone bar 2. Specifically, the vibrating body 31 vibrates when a sound wave generated in the tone bar 2 and transmitted into the air reaches the vibrating body 31. Therefore, reducing the interval between the vibrating body 31 and the plurality of tone bars 2 enables efficient transmission of the sound (vibration) generated in the tone bar 2 to the vibrating body 31. The vibrating body 31 vibrates at a frequency corresponding to the frequency of the sound of each tone bar 2.

The vibrating body 31 may be formed in an arbitrary shape such as a bar shape, a tubular shape, a block shape, or the like. The vibrating body 31 of the present embodiment is formed in a plate shape. The plate-like vibrating body 31 easily vibrates with respect to sound travelling towards the vibrating body 31 in its plate thickness direction, and hardly vibrates with respect to sound travelling toward the vibrating body 31 in a direction orthogonal to the plate thickness direction. That is, the plate-shaped vibrating body 31 has high directivity with respect to sound. In the present embodiment, the plate-like vibrating body 31 is arranged such that a surface 31*c* (opposing surface 31*c*) orthogonal to that plate thickness direction faces the tone bar 2 side. Therefore, the vibrating body 31 can vibrate with high sensitivity to sound from the tone bar 2.

The vibrating body 31 may be formed in, for example, a flat plate shape. The vibrating body 31 of the present embodiment is formed in a curved plate shape. Specifically, the plate-shaped vibrating body 31 is curved such that the opposing surface 31*c* of the vibrating body 31 opposed to the tone bar 2 follows the inner surface of the concave portion 21. In the present embodiment, a portion of the vibrating body 31 is positioned within the concave portion 21 of the tone bar 2 so that the opposing surface 31*c* of the vibrating body 31 is located near the inner surface of the concave portion 21. The portion of the vibrating body 31 located in the concave portion 21 faces a section corresponding to the middle 2C of the tone bar 2 in the lengthwise direction.

Figure 4:
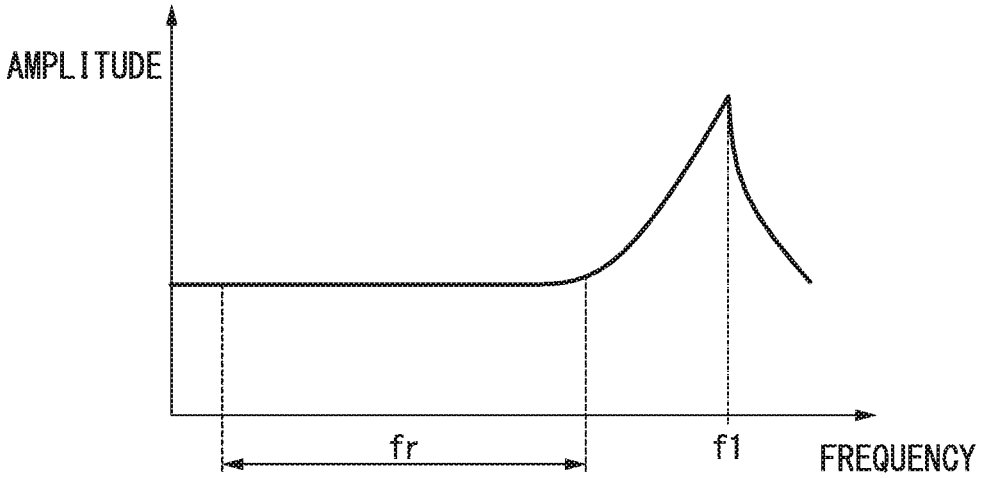
FIG. 4 is a graph showing an example of the frequency characteristic of the vibrating body in the musical instrument pickup according to the one embodiment of the present invention.

As shown in FIG. 4, a resonance frequency fl of the vibrating body 31 differs from a frequency region fr of fundamental tones generated in the plurality of tone bars 2 corresponding to the vibrating body 31. For example, the resonance frequency fl of the first vibrating body 31A differs from the frequency region fr of fundamental tones generated in the plurality of tone bars 2 constituting the first tone bar group 22. The differential between the resonance frequency fl of the vibrating body 31 and the "frequency region fr of fundamental tones" may be small, for example, but a larger differential is more preferred. In FIG. 4, the resonance frequency fl of the vibrating body 31 is higher than the "frequency region fr of fundamental tones," but may also be lower, for example.

The vibrating body 31 should have a high specific rigidity, for example. Increasing the specific rigidity of the vibrating body 31 enables an increase in the resonance frequency fl of the vibrating body 31. That is, the differential between the resonance frequency fl of the vibrating body 31 and the "frequency region fr of fundamental tones" can be increased.

In addition, the attenuation factor of vibration in the vibrating body 31 should be greater than the attenuation factor of sound generated in the tone bars 2, for example.

The material constituting the vibrating body 31 may be arbitrarily determined, with examples including paper, wood, resin, metal foil, or a composite material thereof. The structure of the vibrating body 31 may be arbitrarily determined, with examples including a solid construction not including air bubbles, a foam structure including air bubbles, a honeycomb structure, or the like. When the structure of the vibrating body 31 is a foam structure or a honeycomb structure, it is possible to increase the specific rigidity of the vibrating body 31 compared with the case of a solid structure.

As shown in FIGS. 1 to 3, the vibrating body 31 is held at a predetermined position with respect to the plurality of tone bars 2. The method of holding the vibrating body 31 may be arbitrarily determined. In the present embodiment, the vibrating body 31 is supported so as to be capable of freely vibrating with respect to the frame 3 (support body), whereby the vibrating body 31 is held at a position on the lower side of the plurality of tone bars 2. The vibrating body 31 being able to freely vibrate with respect to the frame 3 means that the vibrating body 31 can vibrate without being restricted by the frame 3.

Specifically, the vibrating body 31 is suspended from the frame 3 by a suspender 5 and thereby supported in a manner capable of freely vibrating with respect to the frame 3. The suspender 5 may be any kind provided at least a tensile force is generated as a result of being pulled, with examples including a string, a thread, a chain or the like. In addition, the suspender 5 may be elastically expandable and contractible like a spring or a rubber band. In the illustrated example, the vibrating body 31 is suspended from the first beam 11 and the second beam 12 of the frame 3 by the suspender 5, but the manner of suspension is not limited thereto. The vibrating body 31 may also for example be suspended from a support body that is separate from the frame 3.

The sensor 32 detects vibration of the vibrating body 31. The sensor 32 outputs an electrical signal corresponding to the vibration of the vibrating body 31.

The sensor 32 should at least be disposed on the vibrating body 31 at a position or in a direction that efficiently detects the vibration of the vibrating body 31 accompanying a sound from the tone bar 2. In the present embodiment, the sensor 32 is disposed adjacent to the plate-shaped vibrating body 31 in the thickness direction thereof. As illustrated in FIGS. 1 and 3, the sensor 32 may be disposed on the opposing surface 31*c* side of the vibrating body 31, but may also be disposed on the surface side of the vibrating body 31 facing away from the opposing surface 31*c*, for example. In addition, the sensor 32 may be disposed, for example, at a position overlapping with the tone bar 2 in plan view as viewed from the Z-axis direction, but in the present embodiment, as shown in FIG. 1, the sensor 32 is disposed at a position not overlapping with the tone bar 2.

The sensor 32 may be in contact with the vibrating body 31 or may not be in contact therewith. Examples of the sensor 32 in contact with the vibrating body 31 (contact-type sensor) include a vibration sensor, an acceleration sensor, a speed sensor, a displacement sensor, and the like. Examples of the sensor 32 not in contact with the vibrating body 31 (non-contact type sensor) include a sound pressure sensor, a light sensor, and the like. The sensor 32 of the present embodiment is a contact-type sensor as illustrated in FIG. 3. The sensor 32 may be attached to the vibrating body 31 by an arbitrary method such as screwing or adhesion (adhesion using an adhesive or a double-sided tape, for example).

The sensor 32 may for example be in direct contact with the vibrating body 31. In the present embodiment, as shown in FIG. 3, a cushioning material 33 is interposed between the vibrating body 31 and the sensor 32. That is, the sensor 32 contacts the vibrating body 31 via the cushioning material 33.

The cushioning material 33 is characterized by having a vibration transmission efficiency that decreases as the frequency of vibration in the vibrating body 31 increases. The cushioning material 33 should have a high vibration transmission efficiency in the "frequency region fr of fundamental tones" (see FIG. 4) and a low vibration transmission efficiency in a frequency band higher than the "frequency region fr of fundamental tones" (that is, a frequency band including the resonance frequency fl of the vibrating body 31).

The viscosity of the cushioning material 33 is preferably higher than that of the vibrating body 31. Specific examples of the cushioning material 33 include sponge, felt, rubber, wood and the like.

A plurality of the sensors 32 may for example be provided on the same vibrating body 31. In this case, the plurality of sensors 32 should be spaced apart from each other. In the present embodiment one sensor 32 is provided on the same vibrating body 31.

In the musical instrument pickup 4 of the present embodiment, sound of the tone bars 2 can be picked up by detecting vibration of the vibrating body 31 according to the sound from the tone bars 2 with the sensor 32.

According to the musical instrument pickup 4 and the keyboard percussion instrument 1 of the present embodiment, the vibrating body 31 and the sensor 32 do not come into contact with the tone bar 2. Therefore, the musical instrument pickup 4 can pick up sounds of the keyboard percussion instrument 1 without affecting the acoustic characteristics of the tone bar 2. In addition, since the sounds of the plurality of tone bars 2 can be detected by the one vibrating body 31 and the sensor 32, mounting and maintenance of the musical instrument pickup 4 can be easily performed.

Further, since the sensor 32 and the number of wires connected to the sensor 32 can be reduced, the musical instrument pickup 4 can be manufactured at low cost.

According to the musical instrument pickup 4 and the keyboard percussion instrument 1 of the present embodiment, the dimension of the vibrating body 31 in the arrangement direction (the X-axis direction) of two tone bars 2 out of the plurality of tone bars 2 is greater than the distance between two tone bars 2. Thereby it is possible to reliably detect the sound of two or more tone bars 2 with one vibrating body 31 and the sensor 32.

Further, according to the musical instrument pickup 4 and the keyboard percussion instrument 1 of the present embodiment, the resonance frequency fl of the vibrating body 31 differs from the "frequency region fr of fundamental tones" generated in the plurality of tone bars 2. For that reason, it is possible to suppress resonance of the vibrating body 31 arising from sounds of predetermined frequencies generated in the tone bars 2. It is thereby possible to prevent a sound of a predetermined frequency from being picked up by the musical instrument pickup 4 at a higher sound pressure than a sound of another frequency. That is, it is possible to suppress variations in respective volumes of sounds from the plurality of tone bars 2 picked up by the musical instrument pickup 4 depending on the note (occurrence of volume unevenness).

Further, in the musical instrument pickup 4 and the keyboard percussion instrument 1 of the present embodiment, when the attenuation factor of vibration in the vibrating body 31 is greater than the attenuation factor of the sounds generated in the tone bars 2, the following effect is exhibited. Even if the differential between the resonance frequency fl of the vibrating body 31 and the "frequency region fr of fundamental tones" is small, resonance of the vibrating body 31 arising from sounds from the tone bars 2 can be suppressed.

In the musical instrument pickup 4 and the keyboard percussion instrument 1 of the present embodiment, the cushioning material 33 is interposed between the vibrating body 31 and the sensor 32. This makes it possible to lower the sensitivity of the sensor 32 to vibration in a frequency band higher than the "frequency region fr of fundamental tones". When the resonance frequency fl of the vibrating body 31 is included in a high-frequency band, even if the vibrating body 31 vibrates at the resonance frequency fl due to the vibrating body 31 being struck or the like, it is possible to suppress the detection of this vibration by the sensor 32.

In the musical instrument pickup 4 and the keyboard percussion instrument 1 of the present embodiment, the vibrating body 31 is supported so as to freely vibrate with respect to a support body such as the frame 3. Specifically, the vibrating body 31 is suspended from the frame 3 by the suspender 5. Therefore, it is possible to suppress or prevent restriction by a support body such as the frame 3 of the movement of the vibrating body 31 based on sound from the tone bar 2. Thereby the vibrating body 31 can be made to vibrate efficiently with respect to sound from the tone bar 2. For example, even when the sound of the tone bar 2 is small, the vibrating body 31 can be made to vibrate.

In addition, in the keyboard percussion instrument 1 of the present embodiment, since the vibrating body 31 is arranged on the lower surface 2*a* side of the tone bar 2, the musical instrument pickup 4 can efficiently pick up the sound of the tone bar 2. In addition, it is also possible to prevent the vibrating body 31 from interfering with playing of the keyboard percussion instrument 1 (the act of striking the tone bar 2).

In addition, the keyboard percussion instrument 1 of the present embodiment is constituted by providing a musical instrument pickup 4 for picking up sound of the tone bar 2 on the lower surface 2*a* side of the tone bar 2. Therefore, it is possible to constitute a keyboard percussion instrument in which a resonator is removed from a conventional keyboard percussion instrument such as a xylophone, marimba, vibraphone or the like having a resonator. Accordingly, the keyboard percussion instrument 1 can be manufactured at a low cost. In addition, since the keyboard percussion instrument 1 can be reduced in size, the keyboard percussion instrument 1 can be compactly stored and easily carried.

In the keyboard percussion instrument 1 of the present embodiment, the vibrating body 31 is constituted so as to be arranged inside of the frame portion of the frame 3 of the keyboard percussion instrument 1. Therefore, it is possible to easily add the musical instrument pickup 4 to the existing keyboard percussion instrument 1.

Moreover, by disposing the vibrating body 31 inside the frame portion of the frame 3 of the keyboard percussion instrument 1, it is possible to reduce the interval between the vibrating body 31 and the plurality of tone bars 2. Thereby, the sound pressure from the tone bars 2 picked up by the musical instrument pickup 4 can be increased, and the occurrence of acoustic feedback can be suppressed.

In the keyboard percussion instrument 1 of the present embodiment, a part of the vibrating body 31 is positioned within the concave portion 21 of the tone bar 2. Therefore, the vibrating body 31 can be positioned closer to the tone bar 2, and occurrence of acoustic feedback can be further suppressed.

In addition, by positioning the vibrating body 31 in the concave portion 21 of the tone bar 2, the section of the vibrating body 31 positioned in the concave portion 21 can be arranged to face a section corresponding to the middle 2C of the tone bar 2 in the lengthwise direction. Therefore, the vibrating body 31 can be made to vibrate with high sensitivity with respect to the fundamental tone in which the antinode of vibration is positioned at the middle 2C of the tone bar 2, among the sounds generated in the tone bar 2. That is, the fundamental tone generated in the tone bar 2 can be efficiently picked up.

Further, in the musical instrument pickup 4 of the present embodiment, the vibrating body 31 is formed in a plate shape with high directivity to sound. Further, the plate-shaped vibrating body 31 is arranged such that a plane orthogonal to the plate thickness direction faces the tone bar 2 side. Therefore, it is possible for the musical instrument pickup 4 to easily pick up the sound of the tone bar 2, and possible to make sounds other than the tone bar 2 (for example, the sound of a speaker that outputs the sound picked up by the musical instrument pickup 4, sounds of other musical instruments, and the like) less susceptible to being picked up. Thereby, acoustic feedback can be suppressed.

In the musical instrument pickup 4 of the present embodiment, when the vibrating body 31 is formed in a cylindrical shape, the specific rigidity of the vibrating body 31 can be easily increased compared with the case where the vibrating body 31 being plate shaped. Therefore, it is possible to increase the differential between the resonance frequency fl of the vibrating body 31 and the "frequency region fr of fundamental tones". This makes it possible to suppress resonance of the vibrating body 31 arising from sounds of predetermined frequencies generated in the tone bars 2.

In the above embodiment, the vibrating body 31 may be held at a predetermined position with respect to the plurality of tone bars 2 by being placed on an elastic body such as a metallic spring or the like instead of using the suspender 5. The elastic body may for example be arranged on a base that carries the frame 3. In the case where the vibrating body 31 is placed on an elastic body, it is possible to control the vibration mode (eigen mode) of the vibrating body 31 when vibrating at the resonance frequency fl by changing the method of supporting the vibrating body 31 with the elastic body. For example, by changing the number and position of support points for supporting the vibrating body 31 with the elastic body, it is possible to change the positions of the antinodes and nodes of the vibration modes of the vibrating body 31.

Further, in the above embodiment, the vibrating body 31 may be held at a predetermined position with respect to the plurality of tone bars 2 by being placed on a viscoelastic body such as a sponge, a felt member, a rubber member, or the like. In this case, in addition to the above-mentioned effects, the damping factor of vibration in the vibrating body 31 can be improved by the viscosity of the viscoelastic body. Thereby, resonance of the vibrating body 31 arising from sounds from the tone bars 2 can be suppressed.

In the above embodiment, the vibrating body 31 may for example be held at a predetermined position with respect to the plurality of tone bars 2 by an end of the vibrating body 31 being fixed to a support body such as the frame 3 so as not to hinder the vibration of the vibrating body 31 corresponding to the sounds from the tone bars 2. In the case where the vibrating body 31 is located inside a frame portion of the frame 3 as in the above embodiment, for example, an end of the vibrating body 31 may be fixed to any one of the first beam 11, the second beam 12, and the third beam 13 of the frame 3. That is, the vibrating body 31 may be fixed to the frame 3 so as to be a cantilever beam. Both ends of the vibrating body 31 in one direction may also be fixed to the frame 3. That is, the vibrating body 31 may be fixed to the frame 3 so as to be a doubly supported beam.

When the vibrating body 31 is fixed to a support body such as the frame 3 in this way, the resonance frequency fl of the vibrating body 31 can be increased. As a result, the differential between the resonance frequency fl of the vibrating body 31 and the "frequency region fr of fundamental tones" (see FIG. 4) can be increased.

Figure 5:
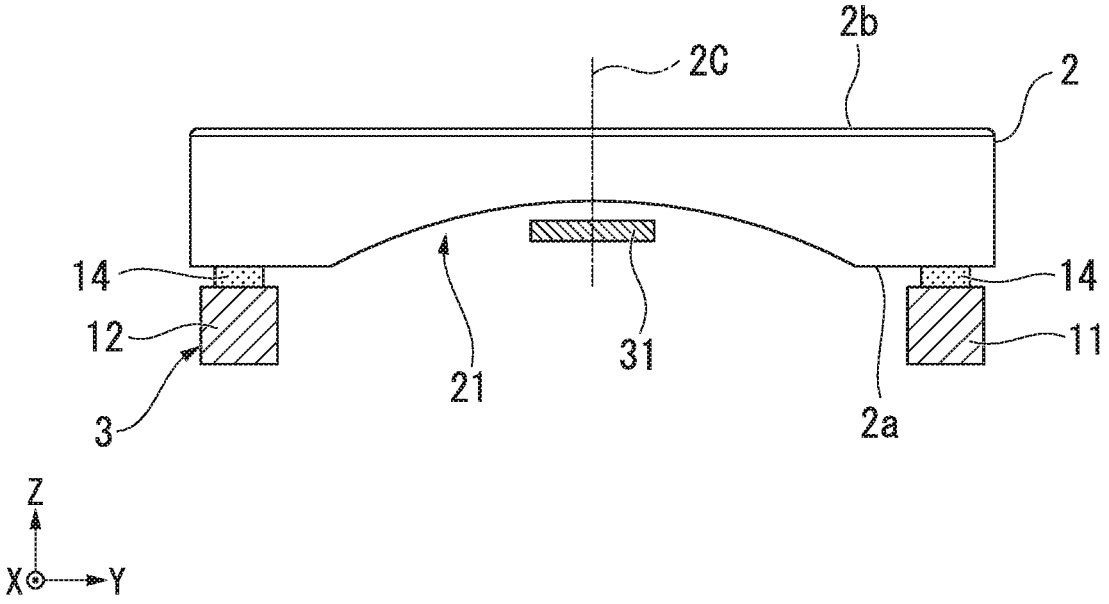
FIG. 5 is a cross-sectional view showing a musical instrument including a musical instrument pickup according to another embodiment of the present invention.

In the above embodiment, the entire vibrating body 31 may be positioned within the concave portion 21 of the tone bar 2 as shown for example in FIG. 5. Moreover, in the above-described embodiment, the entire vibrating body 31 may be arranged so as to face the middle 2C section of the tone bar 2 as shown for example in FIG. 5. In this case, the fundamental tone generated in the tone bar 2 (the sound generated corresponding to the primary mode vibration) can be picked up more efficiently than sounds generated corresponding to the secondary mode vibration of the tone bar 2.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

In the musical instrument pickup of the present invention, the vibrating body may be constituted with a case that accommodates, for example, the plurality of tone bars and the frame. The vibrating body may also be constituted by, for example, a desk or a table on which a keyboard percussion instrument is placed. In these cases, since it is not necessary to prepare a dedicated vibrating body, it is possible to inexpensively introduce a musical instrument pickup.

The musical instrument pickup of the present invention is not limited to the keyboard percussion instrument of the above embodiment and can be applied to any musical instrument having a plurality of sound sources such as other keyboard percussion instruments like a celesta as well as chimes, and the like.

According to the present invention, since the vibrating body and the sensor do not make contact with the sound source, the sound of the sound source can be picked up without affecting the acoustic characteristics of the sound source. In addition, since the sounds of a plurality of sound sources can be detected by one vibrating body and the sensor, it is possible to easily perform mounting and maintenance of the musical instrument pickup.

What is claimed is:

1. A musical instrument pickup comprising:

a vibrating body that is disposed facing a plurality of sound sources included in a musical instrument and configured to vibrate in response to sounds from the plurality of sound sources, the vibrating body having an attenuation factor of vibration greater than an attenuation factor of sound generated in the plurality of sound sources; and a sensor configured to detect a vibration of the vibrating body.

2. The musical instrument pickup according to claim 1, wherein the sensor is disposed on the vibrating body.

3. The musical instrument pickup according to claim 2, wherein a cushioning material is disposed between the vibrating body and the sensor.

4. The musical instrument pickup according to claim 1, wherein a resonance frequency of the vibrating body differs from a frequency region of fundamental tones generated in the plurality of sound sources.

5. The musical instrument pickup according to claim 1, wherein the vibrating body is supported so as to vibrate freely with respect to a support body.

6. The musical instrument pickup according to claim 1, wherein the vibrating body extends in an arrangement direction of any two sound sources of the plurality of sound sources; and a dimension of the vibrating body in the arrangement direction is greater than a distance between the two sound sources.

7. A musical instrument comprising:

a plurality of sound sources; and a musical pickup, the musical pickup including:

a vibrating body that is formed in a planar shape, disposed facing the plurality of sound sources, and configured to vibrate in response to sounds from the plurality of sound sources; and a sensor configured to detect a vibration of the vibrating body, wherein the vibrating body is arranged such that a surface orthogonal to a plate thickness direction of the vibrating body faces the sound sources.

8. The musical instrument according to claim 7, wherein the sensor is disposed on the vibrating body.

9. The musical instrument according to claim 7, wherein the plurality of sound sources include tone bars each having a concave portion; and at least a portion of the vibrating body is positioned within the concave portion of the tone bars.

10. The musical instrument pickup according to claim 7, wherein the vibrating body has an attenuation factor of vibration greater than an attenuation factor of sound generated in the plurality of sound sources.

11. The musical instrument pickup according to claim 7, wherein a cushioning material is disposed between the vibrating body and the sensor.

12. The musical instrument pickup according to claim 7, wherein a resonance frequency of the vibrating body differs from a frequency region of fundamental tones generated in the plurality of sound sources.

13. The musical instrument pickup according to claim 7, wherein the vibrating body is supported so as to vibrate freely with respect to a support body.

14. The musical instrument pickup according to claim 7, wherein the vibrating body extends in an arrangement direction of any two sound sources of the plurality of sound sources; and a dimension of the vibrating body in the arrangement direction is greater than a distance between the two sound sources.

15. A musical instrument pickup comprising:

a vibrating body that is formed in a planar shape, disposed facing a plurality of sound sources included in a musical instrument, and configured to vibrate in response to sounds from the plurality of sound sources; and a sensor configured to detect a vibration of the vibrating body, wherein the vibrating body is arranged such that a surface orthogonal to a plate thickness direction of the vibrating body faces the sound sources.

16. The musical instrument pickup according to claim 15, wherein the sensor is disposed on the vibrating body.

17. The musical instrument pickup according to claim 16, wherein a cushioning material is disposed between the vibrating body and the sensor.

18. The musical instrument pickup according to claim 15, wherein a resonance frequency of the vibrating body differs from a frequency region of fundamental tones generated in the plurality of sound sources.

19. The musical instrument pickup according to claim 15, wherein the vibrating body is supported so as to vibrate freely with respect to a support body.

20. The musical instrument pickup according to claim 15, wherein the vibrating body extends in an arrangement direction of any two sound sources of the plurality of sound sources; and a dimension of the vibrating body in the arrangement direction is greater than a distance between the two sound sources.

* * * * *